US010619975B2

(12) United States Patent
Randles

(10) Patent No.: US 10,619,975 B2
(45) Date of Patent: Apr. 14, 2020

(54) VISUAL AID FOR AIMING A SHOOTING DEVICE

(71) Applicant: SMWT Ltd., Nantwich (GB)

(72) Inventor: Steven Paul Randles, Nantwich (GB)

(73) Assignee: SMWT LTD., Nantwich (GB)

( * ) Notice: Subject to any disclaimer, the term of this patent is extended or adjusted under 35 U.S.C. 154(b) by 0 days.

(21) Appl. No.: 16/124,406

(22) Filed: Sep. 7, 2018

(65) Prior Publication Data

US 2019/0120593 A1 Apr. 25, 2019

(30) Foreign Application Priority Data

Oct. 19, 2017 (GB) ..... 1717196.8

(51) Int. Cl.
*F41G 1/00* (2006.01)
*F41G 1/06* (2006.01)
*F41G 1/02* (2006.01)

(52) U.S. Cl.
CPC ..... *F41G 1/06* (2013.01); *F41G 1/02* (2013.01)

(58) Field of Classification Search
CPC ..... F41G 11/004; F41G 11/003; F41G 1/027; F41G 1/34; F41C 27/00
USPC ..... 42/111, 112, 144; 362/110
See application file for complete search history.

(56) References Cited

U.S. PATENT DOCUMENTS 5,279,061 A 1/1994 Betz
6,604,315 B1 * 8/2003 Smith ..... F41G 1/027 42/111
7,134,234 B1 * 11/2006 Makarounis ..... F41G 11/004 42/146
2008/0244953 A1 * 10/2008 Kilic ..... F41G 11/003 42/127

FOREIGN PATENT DOCUMENTS

DE 202006015136 U1 3/2007
EP 0325170 7/1989
WO WO 2010/014564 2/2010
WO WO 2012/003401 1/2012
WO WO 2015/131276 9/2015

OTHER PUBLICATIONS

Apr. 13, 2018 UK Search Report under Section 17(5).

* cited by examiner

*Primary Examiner* — Michael D David
(74) *Attorney, Agent, or Firm* — Meister Seelig & Fein LLP; Antonio Papageorgiou

(57) ABSTRACT

A visual aid device is provided for an elongate item of equipment intended, in use, to be launched or to launch a projectile at a target region, whereby a user performs an aiming process with the item of equipment by looking along the length thereof from a proximal end to its opposing distal end and directing the distal end in respect of the target region. The visual aid device includes a contrasting region or member located on the item of equipment nearer to the distal end than the proximal end thereof, and being positioned thereon and configured such that it is only fully visible in the peripheral vision of one of the user's eyes during the aiming process.

8 Claims, 4 Drawing Sheets

VISUAL AID FOR AIMING A SHOOTING DEVICE

FIELD OF THE INVENTION

This invention relates generally to a visual aid for use with a shooting device, such as a firearm, a projectile, such as an archery arrow, or other equipment, such as a cricket bat or golf club, that is required to be aimed. The invention extends to a device or equipment including such a visual aid, and a method of shooting/launching/hitting a projectile using such a device or equipment.

BACKGROUND OF THE INVENTION

There are many different types of shooting device in common use today, in relation to sport and recreation, law enforcement and crime prevention, protection of people and/or property, and military applications. Accordingly, many different types of weapons/equipment exist in this regard, depending on their intended use. Thus, for example, tazers and firearms are used by military personnel, the police and other law enforcement agencies, shotguns are used in the sports of clay pigeon shooting and target shooting, and bows and arrows are used in the sport of archery. Other sports that involve accurately launching or hitting a projectile, such as a ball, include cricket and golf, both of which utilize a bat or club to hit a ball in a targeted direction.

Ocular dominance is a natural phenomenon in which the brain prefers visual input from one eye over the other, and which goes largely unnoticed in most human activities which require aim, such as those noted above and many others. Cross dominance in particular can cause such problems to be exacerbated, where a person's dominant eye is on the side of their non-dominant hand, e.g. where a right handed person has a dominant left eye.

In shooting, for example, the shooter must relate the gun to a target by focusing on it with both eyes. However, cross dominant shooters cannot see the barrel correctly when the shotgun is mounted on the side of their dominant hand. This makes it very difficult for them to judge the real location of the barrel and thus relate it to the target accurately. Another such issue in shooting is the sight of a double image, or ghost image, of the barrel while looking with both eyes at a target in the distance, and may appear stronger depending on how weak the shooter's ocular dominance is. Seeing a strong double image of the barrel may confuse the shooter about its correct position, and again make it difficult to relate it to the target accurately. Both of these issues can, of course, have a severe detrimental effect on the shooter's aim and, therefore, performance. Similar issues arise in other sports, pastimes and applications, where accurate aim of an elongate piece of equipment is required.

U.S. Pat. No. 8,844,188 describes apparatus, specifically designed for shoulder-mounted firearms, that seeks to address these issues, specifically in relation to shooters having ocular cross dominance. The apparatus comprises a base having a threaded hole for receiving an upstanding rod. The rod includes a slit for receiving a semi-transparent blade, and the base includes a longitudinal slit for mounting to the trigger guard of a shotgun for use. When so mounted, and with the firearm shouldered on the side of the dominant hand, the blade covers the line of sight of the shooter's other eye, such that it cannot see the barrel or aiming bead, but allows that eye to see the target at all times. The principal utility of the described device is to allow shooters with ocular cross dominance to shoot from their dominant hand, with both eyes open and without causing eyestrain, but it obscures one of the shooter's eyes.

However, there are number of drawbacks with known devices of this type. Firstly, although the target is visible to both eyes, the barrel and aiming bead are obscured from one eye, whereas it is highly preferable to maintain maximum visibility to both eyes when taking aim. Furthermore, the described device is only suitable for counteracting the effects of ocular cross dominance, rather than ocular dominance more generally. Still further, the device is specifically intended for, and suitable only when mounted using a shoulder-mounted firearm used for shooting moving targets, whereas it would be highly desirable to provide an apparatus and method for use more generally in counteracting the effects of ocular cross dominance in a wide range of pastimes and applications in which accurate aiming of an elongate item of equipment is required, and aspects of the present invention seek to address at least some of the above issues.

SUMMARY OF THE INVENTION

In accordance with a first aspect of the invention, there is provided a visual aid device for an elongate item of equipment intended, in use, to be launched or to launch a projectile at a target region, whereby a user performs an aiming process with said item of equipment by looking along the length thereof from a proximal end to its opposing distal end and directing said distal end in respect of said target region, said visual aid device comprising a contrasting region or member located on said item of equipment nearer to said distal end than the proximal end thereof, and being positioned thereon and configured such that it is only fully visible in the peripheral vision of one of the user's eyes during a said aiming process.

In an exemplary embodiment, the visual aid device may comprise a protruding member affixed or formed on one side of a said elongate item of equipment and configured to protrude generally laterally therefrom such that it is only fully visible in the peripheral vision of a user's eye at said one side of said item of equipment during a said aiming process.

The protruding member is beneficially configured so as to be substantially obscured from view in respect of the user's other eye during a said aiming process. However, it is envisaged that a small portion (e.g. less than 49%) of the visual aid device may be visible to the user's other eye.

The protruding member may be removably affixed, e.g. by magnetic means, on said one side of a said elongate item of equipment.

In a specific exemplary embodiment, the protruding member may be generally cylindrical, although the present invention is not intended to be in any way limited in this regard.

The protruding member may, for example, have a diameter between 2 and 6 mm and a length between 3 and 8 mm, and be configured to be affixed or formed on one side of said elongate item of equipment such that its longitudinal dimension protrudes generally laterally from said one side thereof.

The protruding member may, alternatively, be formed integrally with a portion of said elongate item of equipment.

In one specific exemplary embodiment, the elongate item of equipment may be a shotgun and said visual aid device may be located on one side of the barrel thereof, nearer to the muzzle end than the opposing proximal end.

In accordance with another aspect of the present invention, there is provided a kit of parts comprising a visual aid device substantially as described above, and means for affixing said device on an elongate item of equipment intended, in use, to be launched or to launch a projectile at a target region, such that the visual aid device is only fully visible in the peripheral vision of one of the user's eyes during an aiming process.

In accordance with another aspect of the present invention, there is provided an elongate item of equipment intended, in use, to be launched or to launch a projectile at a target region, comprising a visual aid device substantially as described above located on said item of equipment nearer to said distal end than the proximal end thereof, and being positioned thereon and configured such that it is only fully visible in the peripheral vision of one of the user's eyes during a said aiming process.

In accordance with yet another aspect of the present invention, there is provided a method of manufacturing an elongate item of equipment intended, in use, to be launched or to launch a projectile at a target region, whereby a user performs an aiming process with said item of equipment by looking along the length thereof from a proximal end to its opposing distal end and directing said distal end in respect of said target region, the method comprising affixing or forming on said item of equipment a contrasting region or member nearer to said distal end than the proximal end thereof, said contrasting region being configured and positioned thereon such that it is only fully visible in the peripheral vision of one of the user's eyes during a said aiming process.

In a preferred exemplary embodiment, the method includes the step of affixing or forming said contrasting region or member on the same side of said item of equipment as the intended user's dominant hand.

In an exemplary embodiment, the contrasting region may be provided by a protruding member and the method includes the step of affixing or forming a said protruding member on one side of said elongate item of equipment so as to protrude generally laterally therefrom such that it is only fully visible in the peripheral vision of a user's eye at said one side of said item of equipment during a said aiming process.

These and other aspects of the invention will be apparent from the following Detailed Description.

BRIEF DESCRIPTION OF THE DRAWINGS

Embodiments of the present invention will now be described, by way of examples only and with reference to the accompanying drawings, in which.

DETAILED DESCRIPTION

Figure 1:
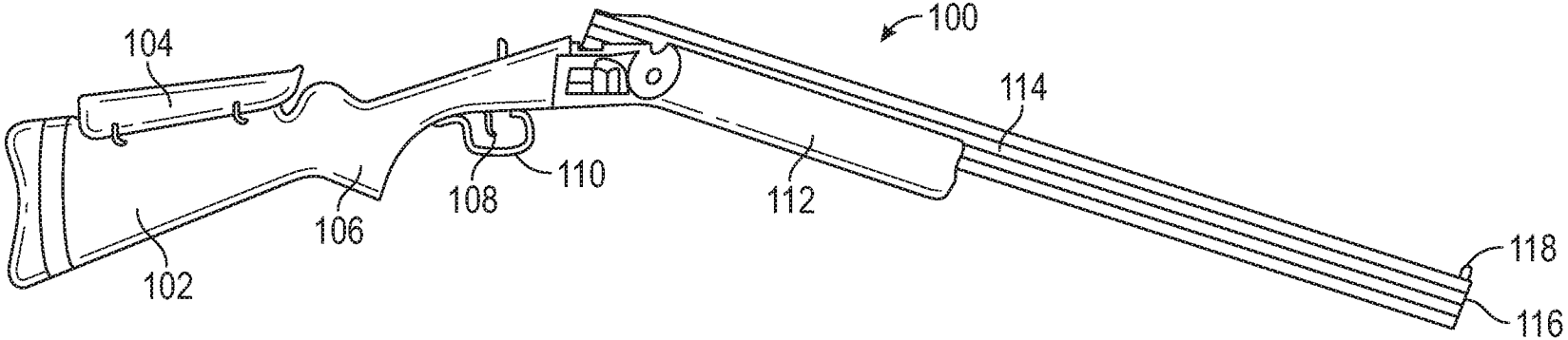
FIG. 1 is a schematic side view of a shotgun.

Referring to FIG. 1 of the drawings, there is illustrated schematically a shotgun 100 comprising a stock 102, comb 104, pistol grip 106, trigger 108, trigger guard 110, forearm 112, barrel 114, muzzle 116 and aiming bead 118. It is to be understood that the item of equipment illustrated in FIG. 1 is referenced purely for illustrative purposes, and the present invention is in no way intended to be limited with regard to the firearm with which it is utilized, nor even necessarily with regard to the item of equipment to which it is applied. Thus, the following detailed description is provided in respect of a shotgun, principally for use in clay pigeon shooting and the like, but it is to be understood that other embodiments of the present invention may be applied to other types of firearm or even, more generally, to any item of elongate equipment required to be accurately aimed in use.

Figure 2:
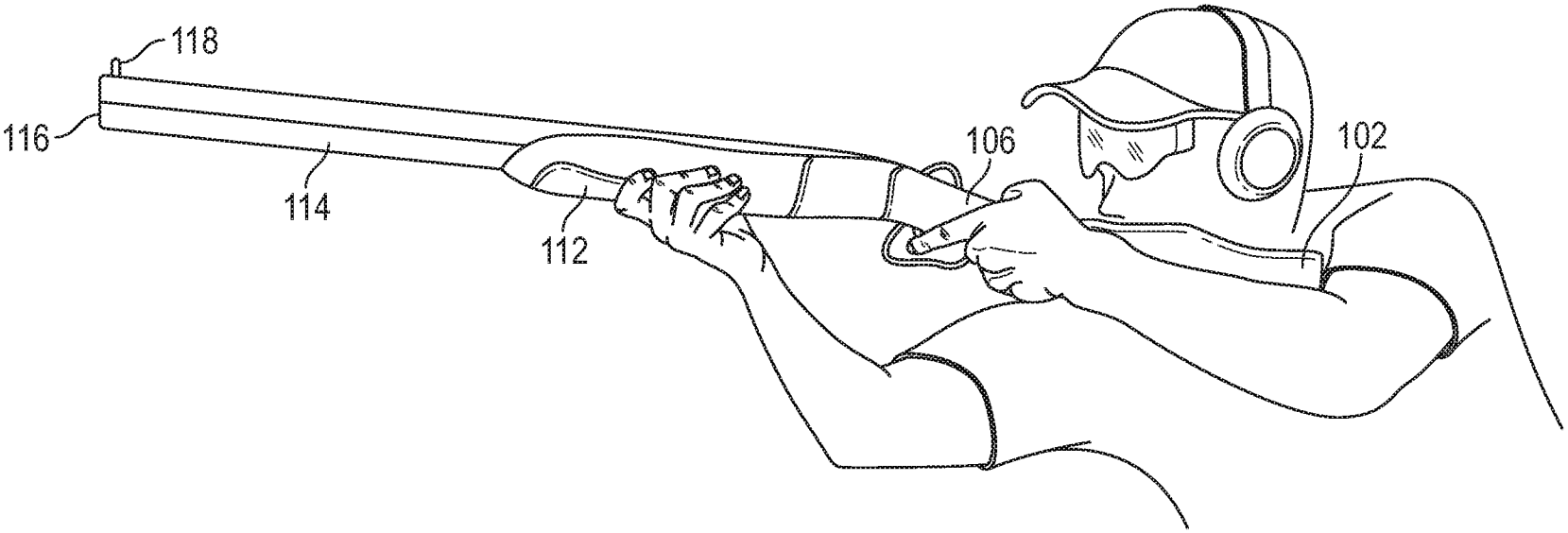
FIG. 2 is a schematic side view of a shotgun in use.

Referring now to FIG. 2 of the drawings, in general use, a shotgun 100 of the type illustrated in FIG. 1 of the drawings is placed with the stock 102 resting on the shooter's shoulder on the side of their dominant hand (the left-hand side in FIG. 2), with the dominant hand at the pistol grip 106 and positioned to pull the trigger 108, when required, and the other hand at the forearm 112 supporting the barrel 114. In this firing position, the device is held at the shooter's eye level so that they can look down the barrel 114, with the aiming bead 118 in their line of sight. Using the aiming bead 118, the shooter can line up their shot, aiming the centre of the muzzle 112 at a target (or region in which a target is expected to be at the time of impact), and pull the trigger 108 to fire the shot when ready.

In accordance with an exemplary embodiment of the present invention, a visual aid in the form of a protruding member (not shown in FIG. 2) is provided on the side of the barrel 114 to counteract the effects of ocular dominance, preferably on the same side of the barrel as the shooter's dominant hand.

Figure 3:
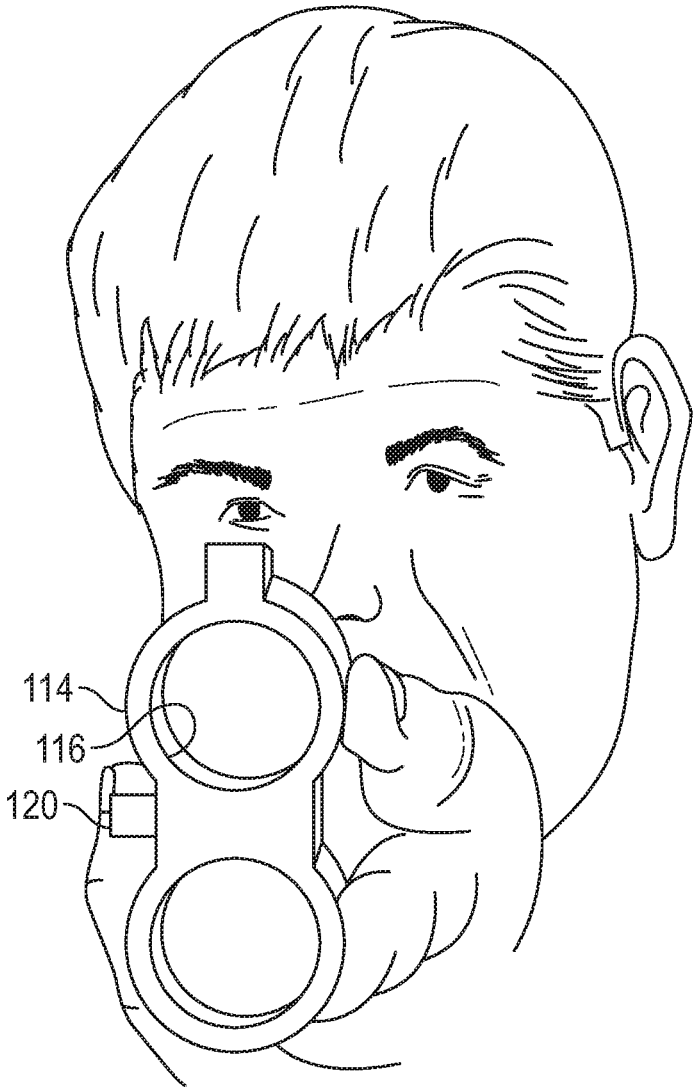
FIG. 3 is a schematic front view of a shotgun including a visual aid according to an exemplary embodiment of the present invention, when in use.

Thus, referring to FIG. 3 of the drawings, a protruding member 120 is affixed at the side of the barrel 114 on the side of the eye that is (or is required to be) dominant (i.e. the eye on the same side as the shooter's dominant hand). In FIG. 3, the shooter's dominant hand is their right hand, and their dominant eye should be their right eye, so the protruding member 120 is placed on the shooter's right side to act as a visual aid to the right (dominant) eye. However, in alternative exemplary embodiments, the shooter's left hand might be dominant and the shooter may have a dominant left eye (or wish to force their left eye to be dominant), in which case the protruding member 120 is placed on the same side as the dominant hand (i.e. the left), and the present invention is not necessarily intended to be limited in this regard.

The protruding member 120 should be sized and positioned such that it is only fully visible to the dominant eye (or the eye that the shooter wants to be dominant). Ideally, it is positioned such that the view of the protruding member 120 may be substantially obscured relative to the non-dominant eye, although this may not be absolutely essential, and in alternative exemplary embodiments, a small portion (e.g. less than 50%) of the protruding member may be visible to the non-dominant eye, in use, and still provide adequate results, provided it is fully visible to the dominant eye. Furthermore, it is to be understood that the protruding member is not positioned for the shooter to look directly at in use. The shooter will still use the aiming bead (or other means) in their direct line of sight to aim the shotgun in the usual manner. The protruding member 120 will simply be present, possibly as a silhouette, within the peripheral vision of the dominant eye, thereby providing a constant point of reference therein.

As such, the position and size of the protruding member will be dependent on the type, size and length of the equipment on which it is being used, so that a) it is constantly and fully visible within the peripheral vision of the dominant eye (or the eye the user wishes to be dominant), b) it cannot be seen, or it can only be partially seen, by the other eye in use, and c) it is not in the direct line of sight of the dominant eye during an aiming process. Other than that, and as will be understood by a person skilled in the art, there are no specific limitations as to the shape, configuration, size or positioning of the protruding member 120. Indeed, in some exemplary embodiments, particularly, say, in sporting equipment such as cricket bats and golf clubs, the visual aid may not comprise a protruding member at all (i.e. may not have a raised silhouette that protrudes laterally from the side of the equipment, but may instead be a coloured member having a substantially flat silhouette profile. The protruding may, for some applications, be coloured or provided with a fluorescent coating to ensure that it can be seen in low light conditions.

Returning to FIG. 3 of the drawings, in order to obtain the above-mentioned objectives in relation to a shotgun, the protruding member is likely to be positioned on the side of the barrel (corresponding to the dominant eye) within around 15 cm or so from the muzzle end. The protruding member may protrude laterally from the location at which it is affixed or formed by, say, 4 to 10 mm, but again this is dependent on the equipment on which it is being used. In the exemplary embodiment illustrated in FIG. 3 of the drawings, an over/under shotgun is provided with a protruding member 120 that is conveniently affixed, close to the muzzle end, on the flat portion between the top and bottom barrels, but the present invention is, of course, not intended to be limited in this regard.

Figure 4:
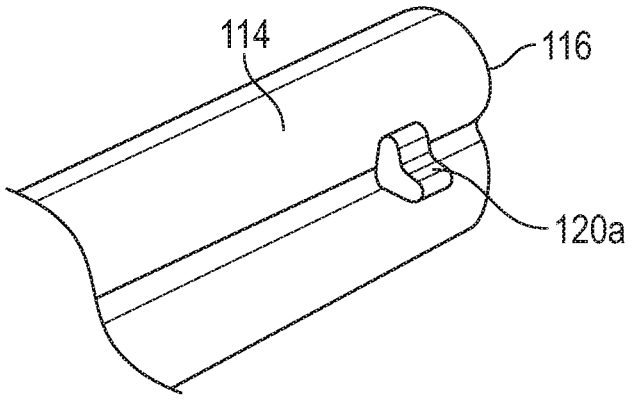
FIG. 4 is a schematic perspective view of the muzzle end of a shotgun, including a visual aid according to an exemplary embodiment of the present invention.
Figure 5:
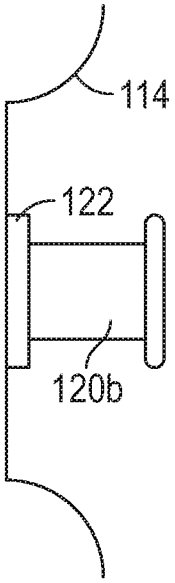
FIG. 5 is a schematic side view of a muzzle end of a shotgun including a visual aid according to another exemplary embodiment of the present invention.

The protruding member (or other visual aid) may be integrally formed, or permanently fixed, in the desired position and configuration on the device/equipment on which it is to be used. Alternatively, a kit of parts may be provided comprising a visual aid and means for affixing the visual aid, permanently or otherwise, to a pre-existing device or item of equipment. Thus, for example, referring to FIG. 4 of the drawings, in a first exemplary embodiment, a protruding member 120*a* may be integrally formed at the intersection between the barrels of an over/under shotgun. In an alternative exemplary embodiment, a generally cylindrical member 120*b*, of around 3-6 mm in diameter and length 4-10 mm, may be retrofitted to an existing device by affixing it, removably or otherwise, at the intersection between the barrels of an over/under shotgun. For example, a magnet 122 may first be affixed (e.g. by means of an adhesive) to the device, and the cylindrical member 120*b* subsequently affixed thereto by magnetic force. However, it is to be understood that the present invention is not intended to be limited in this regard. It may be more preferable to permanently or at least semi permanently affix the protruding member to the barrel, for safety reasons, but the present invention is not necessarily intended to be limited in this regard.

In use, and referring back to FIG. 3 of the drawings, even before the shooter raises the shotgun and rests the stock thereof on their shoulder on the side of their dominant hand, as described with reference to FIG. 2 of the drawings, the visual aid device of the present invention can be used to "control" the dominant eye. The shotgun can simply be held at the shooter's eye level so that the aiming bead 118 is in the direct line of sight of both eyes. The protruding member 120 will, in this case, be fully in the peripheral vision of the shooter's dominant eye (or the eye they wish to be dominant) which is the eye on the same side as the shooter's dominant hand. Keeping both eyes open, the shooter can use the aiming bead 118 to take their aim. The protruding member 120 (or other visual aid) provides a point of reference that remains within the dominant eye's peripheral vision during the initial development of the shot movement, thereby stimulating the brain and allowing/causing the dominant eye to control the view registered by the shooter. Thus, it is to be understood that, using the visual aid device of the present invention, the gun does not need to be shouldered or aimed, but simply held such that the dominant eye can fully 'see' the device and the non-dominant eye cannot, thereby allowing a much more natural style of shooting. When the firearm is eventually mounted and shouldered, the device does not necessarily have to be seen as the dominant eye has already been 'controlled'.

Thus, various aspects of the invention essentially provide a visual aid in respect of an elongate piece of equipment required to be accurately aimed. The visual aid is sized, configured and positioned to remain within the peripheral vision of the eye required to be dominant for applications where it is highly desirable for both eyes to remain open whilst taking aim. The visual aid, so configured and positioned, stimulates the user's brain and causes the visual input from the selected eye to dominate the image registered by the user's brain.

It will be appreciated by a person skilled in the art, from the foregoing description, that modifications and variations can be made to the described embodiments without departing from the scope of the invention as defined by the appended claims. It is to be understood that various aspects of the invention will be beneficial for use with many different types of device and weapon that benefit from both eyes being open during an aiming process, rather than closing or blocking the non-dominant eye. Such devices include, but are not necessarily limited to, Airsoft, air pistols and rifles, paintball devices, tasers, hand guns, shotguns, military weapons, archery arrows, cricket bats, golf clubs, etc. In all cases, the visual aid device operates to stimulate the brain and ensure that it favours the visual input from the eye on the same side as the visual aid device. The visual aid device may comprise a raised profile/silhouette that projects from the side of the device/weapon (on the side of the eye required to be dominant), or it could have a substantially flat (optionally coloured) profile in some applications.

The invention claimed is:

1. A projectile firing device comprising a barrel disposed at a distal end thereof, and a visual aid, whereby a user performs an aiming process with the projectile firing device and visual aid by looking along a length thereof from a proximal end of the projectile firing device to the opposing distal end and directing said distal end in respect of a target region, said visual aid comprising a protruding member located on the projectile firing device nearer to said distal end than the proximal end thereof, and being positioned and affixed to a side of the barrel and configured such that the protruding member is only fully visible in a peripheral vision of one of the user's eyes during said aiming process, the protruding member being configured to protrude generally laterally from the barrel such that the protruding member is only fully visible in the peripheral vision of a user's eye at one side of the projectile firing device during a said aiming process.

2. The projectile firing device according to claim 1, wherein said protruding member is configured so as to be substantially obscured from view in respect of the user's other eye during said aiming process.

3. The projectile firing device according to claim 1, wherein said protruding member is removably affixed on said one side of the barrel.

4. The projectile firing device according to claim 3, wherein said protruding member is removably affixed by magnetic means on said one side of the barrel.

5. The projectile firing device according to claim 1, wherein said protruding member has a diameter between 2 and 6 mm and a length between 3 and 8 mm, and is configured to be affixed or formed on one side of the barrel such that its longitudinal dimension protrudes generally laterally from said one side thereof.

6. The projectile firing device according to claim 1, wherein said protruding member is formed integrally with a portion of the barrel.

7. A method of manufacturing a projectile firing device, the projectile firing device comprising a barrel disposed at a distal end thereof, and a visual aid, whereby a user performs an aiming process with the projectile firing device and visual aid by looking along a length thereof from a proximal end of the projectile firing device to the opposing distal end and directing said distal end in respect of a target region, the method comprising affixing or forming on the barrel of the projectile firing device a protruding member nearer to said distal end than the proximal end thereof, said protruding member positioned and affixed to a side of the barrel such that the protruding member is only fully visible in a peripheral vision of one of the user's eyes during said aiming process, the protruding member being configured to protrude generally laterally from the barrel such that the protruding member is only fully visible in the peripheral vision of a user's eye at one side of the projectile firing device during said aiming process.

8. A method according to claim 7, including the step of affixing or forming said protruding member on the same side of the projectile firing device as the intended user's dominant hand.

* * * * *